US005906482A

United States Patent [19]

Tedman

[11] Patent Number: 5,906,482

[45] Date of Patent: May 25, 1999

[54] DOUBLE WALL VERTICAL COOLER

[75] Inventor: Paul E. Tedman, Sabetha, Kans.

[73] Assignee: Extru-Tech, Inc., Sabetha, Kans.

[21] Appl. No.: 08/886,698

[22] Filed: Jul. 1, 1997

[51] Int. Cl.[6] ..... F27D 15/02

[52] U.S. Cl. ..... 432/77; 432/78

[58] Field of Search ..... 432/77, 78, 80, 432/58, 14

[56] References Cited

U.S. PATENT DOCUMENTS

| | | | |
|---|---|---|---|
| 2,649,224 | 8/1953 | Bardet . | |
| 2,905,365 | 9/1959 | Thayer et al. . | |
| 3,837,792 | 9/1974 | Deussner | 432/77 |
| 3,972,449 | 8/1976 | Smith . | |
| 4,067,120 | 1/1978 | Bradford . | |
| 4,076,493 | 2/1978 | Gardner | 432/77 |
| 4,199,282 | 4/1980 | Johnnson . | |
| 4,217,700 | 8/1980 | Müller . | |
| 4,522,500 | 6/1985 | Hyer . | |
| 4,647,341 | 3/1987 | Lorenz et al. | 202/228 |
| 4,702,019 | 10/1987 | Tsuruno et al. | 432/77 |
| 4,728,287 | 3/1988 | Niems . | |
| 4,781,171 | 11/1988 | Hemsath | 432/14 |
| 4,887,364 | 12/1989 | Geelen | 34/57 |
| 5,106,240 | 4/1992 | Dirkse et al. . | |
| 5,368,874 | 11/1994 | Van Bruggen . | |
| 5,551,168 | 9/1996 | Van Fossen . | |

FOREIGN PATENT DOCUMENTS

| | | | |
|---|---|---|---|
| 461431 | 6/1928 | Germany | 432/78 |

*Primary Examiner*—Teresa J. Walberg
*Assistant Examiner*—Gregory A. Wilson
*Attorney, Agent, or Firm*—Litman, McMahon & Brown, L.L.C.

[57] ABSTRACT

A double wall vertical cooler designed for cooling extruded feed products and the like includes a cooling chamber with an upper cylindrical section and a lower frustoconical section. An outer wall surrounds the frustoconical section of the cooling chamber to form a cooling air circulating chamber. Apertures formed in a wall between the air circulating chamber and the cooling chamber allow cooling air to flow into the cooling chamber near the bottom with air flow exiting near the top as feed product is dropped from a product inlet in the top of the cooling chamber with product exiting at the bottom of the cooling chamber. The cooler design minimizes product breakage and enhances product throughput.

16 Claims, 2 Drawing Sheets

DOUBLE WALL VERTICAL COOLER

FIELD OF THE INVENTION

The present invention relates to a double wall vertical cooler designed primarily to cool extruded feed products, such as pet food, fish food, and the like. More particularly, the vertical cooler includes an inner cooling chamber at least partially surrounded by a cooling air circulating chamber. A number of apertures located near the bottom of the cooling chamber connect the cooling chamber to the circulating chamber to direct cooling air upward as the extruded feed product falls downward in the cooling chamber.

BACKGROUND OF THE INVENTION

In the past, producers of extruded feed products, such as pet food, fish food, etc., have used combination pan dryer/coolers to dry the extruded food products and cool them in one step. More recently it has become a common practice to first dry the product and then fat and flavor coat it prior to cooling. This is because hot, dry products absorb more fat then cooled products. Thus, separate machines are often used for drying, then fat and flavor coating and then cooling.

A typical prior art cooler which is often used for cooling extruded animal feed is shown and described in U.S. Pat. No. 4,887,364 issued Dec. 19, 1989 to Pierre Geelen, entitled DEVICE FOR COOLING AND/OR DRYING BULK GOODS. In this apparatus, a cooling bunker receives bulk goods to be cooled through a rotary airlock feeder positioned on the top thereof. The bunker has a floor consisting of a number of pivotable bars which form a grate. The bars are designed to allow the passage of cooling air therethrough, which cooling air passes through the bulk material in the bunker and up and out of an exhaust port near the top of the bunker. The bars, when pivoted downward, form a substantially solid floor and, when pivoted upward, allow the passage of bulk material through the floor and into a collection hopper.

A number of problems occur with usage of coolers of the type shown in the Geelen '364 patent for cooling extruded animal feed products. The cooler bunker, and, particularly the grate, tends to collect small chunks of product which hang up on the grid due to the large number of flat surfaces involved. The grids also require a substantial effort to clean between production runs, often causing cross-contamination between product types. Product breakage is also a significant factor since feed pellets are broken when the grids open and close. In addition, a considerable time is spent adjusting the grid settings when production is switched between runs of small products such as fish food (e.g. 1.5 mm diameter range) and large products such as dog food (e.g. 15 mm diameter range). Finally, problems result from smaller pellets tending to leak out of the grid while larger pellets tend to collect on the grid.

It is clear that a need exists for an improved cooler specifically designed for cooling extruded feed products. Such a cooler should efficiently cool the extruded product while minimizing product breakage and allowing reliable and consistent flow through of product regardless of product size. The cooler should also be easy to clean between product runs.

SUMMARY OF THE INVENTION

The present invention is directed to a double wall vertical cooler designed for cooling extruded feed products and the like while minimizing product breakage and enhancing product flow through. The inventive cooler includes a cooling chamber with an upper cylindrical section and a lower frustoconical section. A frame supports the cooling chamber off of a floor surface and an outer wall surrounds the cooling chamber to form a cooling air circulating chamber which partially encompasses the cooling chamber. A cooling air inlet draws cooling air from a chilled air source, or simply from the ambient surrounding air, and into the cooling air circulating chamber. A number of apertures extend through the wall of the cooling chamber to allow cooling air to pass from the air circulating chamber into the cooling air chamber. A cooling air exhaust plenum is positioned near the top of the cooling air chamber and includes a blower to create negative pressure in the cooling air chamber. A rotary airlock feeder introduces the hot extruded feed product into the top of the cooling air chamber. As the feed product falls within the cooling chamber, it encounters the rising cooling air drawn upward by the exhaust fan. The product then strikes the slanted side walls of the frustoconical section of the cooling chamber, which also serves to minimize breakage. The feed product is allowed to accumulate in the bottom of the cooling chamber and is metered out of the cooling chamber via a controlled outlet mechanism such as a slide gate, a rotary airlock feeder or a vibratory conveyor. By use of the inventive cooler, feed product breakage is minimized and product cooling is enhanced.

OBJECTS AND ADVANTAGES OF THE INVENTION

The principal objects of the present invention include: providing an improved double wall vertical cooler specifically designed to cool extruded feed products; providing such a cooler which includes a cooling chamber with a lower frustoconical section; providing such a cooler with a cooling air circulating chamber surrounding the frustoconical section of the cooling chamber; providing such a cooler with a plurality of apertures connecting the cooling chamber with the air circulating chamber such that cooling air is introduced into the bottom of the cooling chamber from the air circulating chamber; providing such a cooler which efficiently cools extruded feed products while minimizing breakage and enhancing product throughput; and providing such a cooler which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
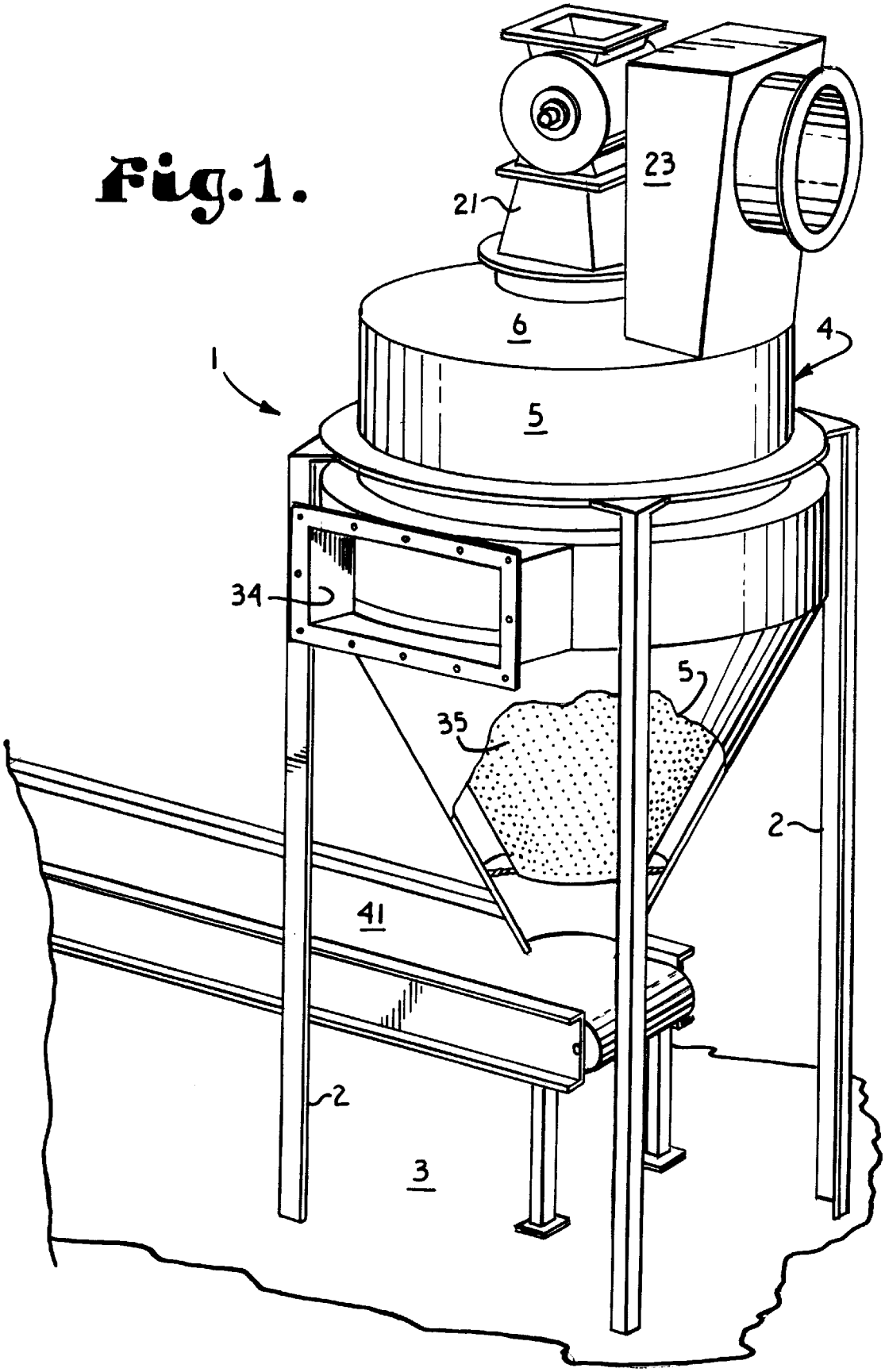
FIG. 1 is a perspective view of a double wall vertical cooler in accordance with the present invention, shown positioned over an endless belt conveyor, and with portions of an outer wall broken away to illustrate the interior of a cooling air circulating chamber and apertures connecting the air circulating chamber to a cooling chamber.
Figure 2:
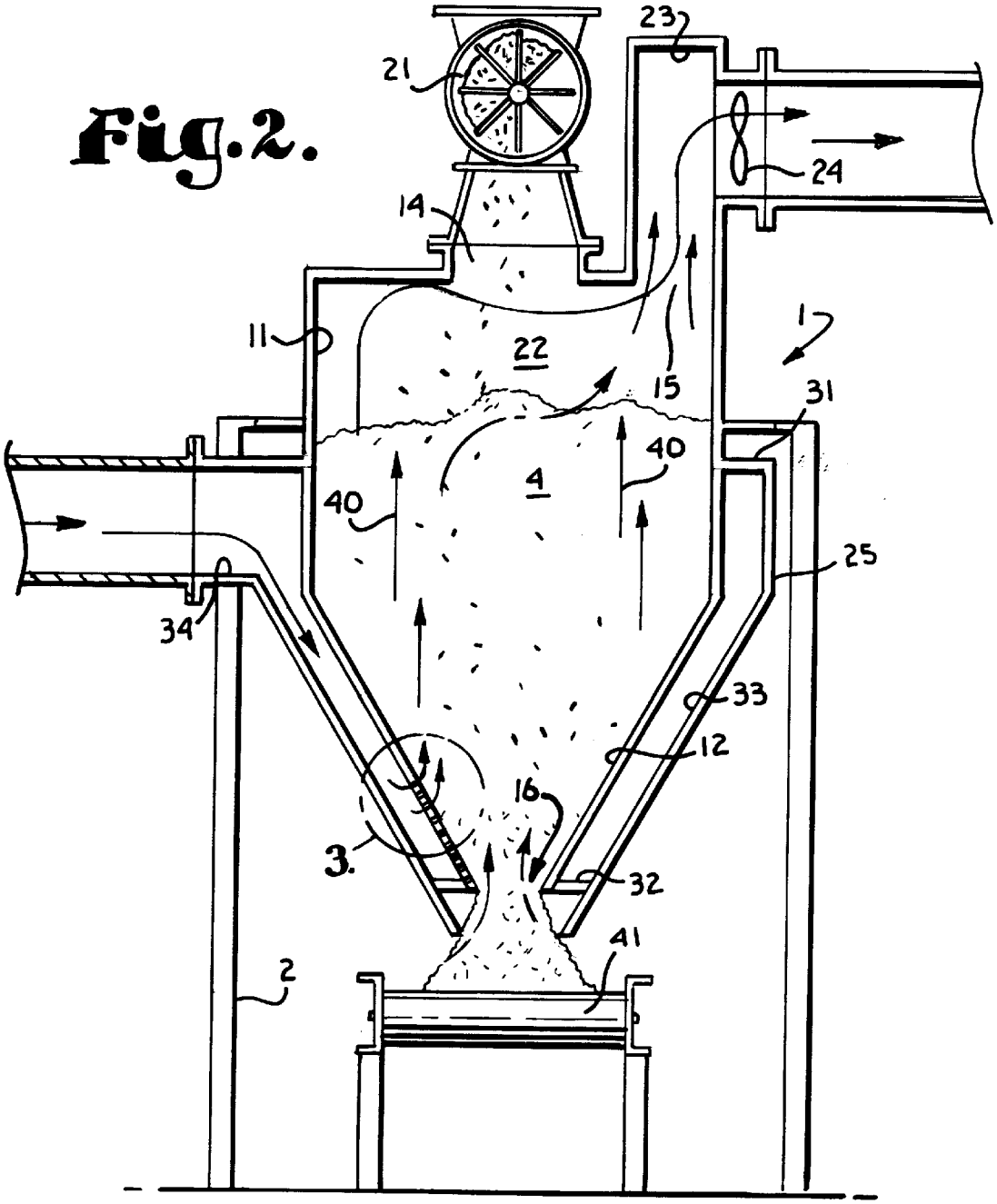
FIG. 2 is a partially schematic, cross sectional view of the double wall vertical cooler of FIG. 1, with feed pellets being introduced at the top and with cooling air flow indicated by arrows.
Figure 3:
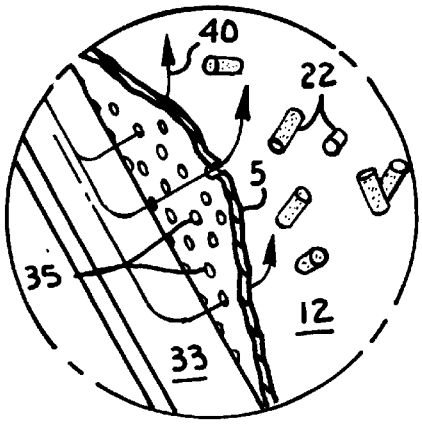
FIG. 3 is a greatly enlarged, fragmentary sectional view of the portion of FIG. 2 shown encircled and indicated by the number 3, showing cooling air entering the cooling chamber from the circulating chamber and feed pellets falling within the cooling chamber.

Referring to FIGS. 1–3, a double wall vertical cooler is illustrated and generally indicated at 1. The cooler 1 includes a supporting frame including a plurality of legs 2 anchored to a floor surface 3. The cooler 1 includes a cooling chamber 4 formed by a continuous wall 5 and a ceiling 6. The cooling chamber 4 includes an upper cylindrical cooling section 11 and a lower frustoconical cooling section 12. The cooling chamber ceiling 6 has a product inlet opening 14, a cooling air exhaust opening 15 and an open product exit opening 16 extends through the bottom of the frustoconical section 12. A conventional rotary airlock feeder 21 is positioned over the product inlet opening 14 to permit extruded feed product, such as the feed pellets 22 shown in FIGS. 2 and 3, to be introduced into the cooling chamber 4 without affecting an air pressure differential between the cooling chamber 4 and the ambient surrounding air. A cooling air exhaust plenum 23 is positioned over the cooling air exhaust opening 15 and an exhaust blower 24 is positioned within the plenum 23 to create negative air pressure within the cooling chamber 4.

A continuous outer wall 25 surrounds the lower frustoconical portion 12 of the cooling chamber 4 and a portion of the upper cylindrical portion 11 as well. The top of the outer wall 25 is attached to the perimeter of the wall 4 via a horizontal ceiling 31. The bottom of the outer wall 25 is attached to the perimeter of the wall 4 via a floor 32. The combination of the outer wall 25, the wall 4, the ceiling 31 and the floor 32 form a cooling air circulating chamber 33 which allows cooling air introduced onto the air circulating chamber 33 via a cooling air inlet 34 to be circulated about the entire periphery of the cooling chamber frustoconical section 12.

A plurality of apertures 35 are formed through the wall 4 about the lower periphery of the lower frustoconical section 12 of the cooling chamber 4. The apertures 35, which can be approximately 1/16" in diameter, extend around the periphery of the frustoconical section 12 to connect the air circulating chamber 33 to the cooling chamber 4. The apertures 35 thus allow cooling air, as indicated by air flow arrows 40, to be drawn from the air circulating chamber 33 into the cooling chamber 4. The cooling air 40 is thus drawn upward through the cooling chamber 4 by the blower 24. The rising air 40 encounters falling and accumulated feed pellets 22, effective and efficiently cooling them. The combination of the elimination of movable grids and the sloped wall 4 of the frustoconical section 12 minimize breakage of the feed pellets 22. Some additional cooling air 40 is drawn through the exit opening 16, as indicated by the additional arrows. The exhausted air is typically routed from the plenum 23 to a cyclonic dust separator, (not shown) before being returned to the atmosphere.

The feed pellets 22 are allowed to accumulate in the bottom of the cooling chamber 4 as they build up on an endless belt conveyor 41. Typically build-up within the cooling chamber 4 is monitored and controlled by intermittent operation of the conveyor 41. Other conveyor types can be used as well, including vibratory conveyors for particularly fragile pellets. An optional slide gate (not shown) or other controlled covering can be provided over the exit opening 16, if desired. The exit flow rate of the pellets 22 is thus controlled to allow them to remain in the cooling chamber 4 long enough to achieve complete cooling. Although the cooling rate depends upon several factors, including pellet size, product density, product temperature in, product throughput, difference between ambient temperature and cooling air temperature, air flow, etc., a typical retention time range for complete cooling of extruded feed products is 10 to 20 minutes.

Performance tests performed on prototypes of the inventive cooler 1 have been excellent. Product breakage is virtually non-existent and the cooler 1 will easily clean out completely with minimal product carry over. In a small, 6000 lb./hr. unit cooler built as a test unit, the following product run is typical:

Product: 3/8×1/2 in×1/4 in chunk food
Density: 22.5 lb/ft$^3$
Rate: 6000 lb/hr
Product Temperature In: 100° F.
Product Temperature Out: 80.5° F.
Air In Temperature: 74° F.
Air Out Temperature: 87° F.
Retention Time: 10 minutes
Chamber Static Pressure: −9 in W.C.
Cooling Air Flow: 5000 CFM The experimental 6000 lb/hr cooler had the following design characteristics:

Product Rate (Lb/Hr): 6000
Product Density (Lb/Cu Ft): 23
Volume per Hour (Cu Ft/Hr): 260.87
Bin Diameter (In): 72
Angle of repose: 30
Height of Product
Along Vertical Wall (In): 3
Angle of Cone: 60
Volume in Upper Section (Cu Ft): 23.39
Volume in Cone (Cu Ft): 48.97
Total Volume (Cu Ft): 72.36
Retention Time (Min): 16.64
Frustoconical Section Aperture Dimensions
Large (In): 48
Small (In): 18
Angle: 60
Length Along Side: 30
Total Screen Area: 21.60
Open Area of Perforated Metal(%): 0.33
Actual Open Area (Sq Ft): 7.13
CFM Per Ton: 1500
Air Volume Required: 4500
Inlet Width (In): 36
Inlet Length (In): 18
Inlet Velocity (Ft/Mn): 1000
Velocity Thru Screen (Ft/Mn): 631
Velocity in Cooling Ch.(Ft/Mn): 159
Discharge Plenum Width (In): 36
Discharge Plenum Length (In): 18
Velocity In Hood (Ft/Mn): 1000
Duct Size @ 2500 Ft/Mn (In): 18.17

Other coolers of varying sizes are planned, including 10000, 16000 and 24000 lb/hr units with proportionately larger design criteria. Therefore, the above dimensions and design criteria are presented as exemplary in nature and are not intended to be limiting in any way.

While the cooler 1 has been described as usable with a belt conveyor 41, other controlled conveyances can be used as well, including an additional rotary airlock feeder, a vibratory conveyor, etc. The cooling air 40 can be provided at ambient temperatures, or can be cooled via refrigeration equipment (not shown). Other details of the cooler 1 featured herein are exemplary as well, including the relative sizes of cylindrical and frustoconical cooling sections 12 and 11, respectively, the positioning of product inlet 14, air inlet 34 and exhaust opening 15, etc.

It is thus to be understood that while certain forms of the present invention have been illustrated and described herein, it is not to be limited to the specific forms or arrangement of parts described and shown.

I claim:

1. A double wall vertical cooler, comprising:

(a) a first continuous wall and a ceiling which together form a cooling chamber, said first continuous wall including a tapered portion such that the diameter of said cooling chamber narrows from top to bottom of said tapered portion;

(b) a second continuous wall at least partially surrounding and connected to said first continuous wall to form a cooling air circulating chamber immediately outside of said cooling chamber;

(c) a cooling air inlet into said air circulating chamber;

(d) a product inlet in said cooling chamber;

(e) a product outlet in said cooling chamber;

(f) an exhaust outlet formed in said cooling chamber; and (g) a plurality of apertures formed in said tapered portion of said first continuous wall which apertures connect said air circulating chamber to said cooling chamber, said apertures being spaced from each other such that said plurality of apertures are arrayed over an area encompassing a substantial portion of said tapered portion of said first continuous wall.

2. A cooler as in claim 1, wherein said tapered portion of said continuous wall forms a frustoconical section of said cooling chamber.

3. A cooler as in claim 2, wherein said product outlet is formed by the lower end of said frustoconical section of said cooling chamber.

4. A cooler as in claim 3, and further comprising a controlled exit device positioned in said product outlet.

5. A cooler as in claim 4, wherein said controlled exit device is a slide gate.

6. A cooler as in claim 1, wherein said first continuous wall also includes an upper portion which is substantially vertical.

7. A cooler as in claim 6, wherein said upper portion of said continuous wall forms a cylindrical section of said cooling chamber.

8. A cooler as in claim 1, wherein said exhaust outlet is formed in said cooling chamber ceiling.

9. A cooler as in claim 8, and further comprising:

(a) an exhaust plenum attached to said exhaust outlet; and (b) a blower positioned in said exhaust plenum.

10. A double wall vertical cooler, comprising:

(a) a first continuous wall and a ceiling which together form a cooling chamber, said first continuous wall including a lower portion which is angled downward and inward to form a product outlet;

(b) a second continuous wall at least partially surrounding said lower portion of said first continuous wall and connected to said first continuous wall to form a cooling air circulating chamber immediately outside of said cooling chamber;

(c) a cooling air inlet into said air circulating chamber;

(d) a product inlet in an upper section of said cooling chamber;

(e) an exhaust outlet formed in said upper section of said cooling chamber; and (f) a plurality of apertures formed in said lower portion of said first continuous wall which apertures connect said air circulating chamber to said cooling chamber, said apertures being spaced from each other such that said plurality of apertures are arrayed over an area encompassing a substantial portion of said lower portion of said first continuous wall, each of said apertures being sized to allow cooling air to enter said cooling chamber from said air circulating chamber but being too small to allow product to pass from said cooling chamber to said air circulating chamber.

11. A cooler as in claim 10, wherein:

(a) said lower portion of said continuous wall forms a lower frustoconical section of said cooling chamber; and (b) said product outlet is formed by a lower end of said frustoconical section of said cooling chamber.

12. A cooler as in claim 10, and further comprising a controlled exit device positioned in said product outlet.

13. A cooler as in claim 10, wherein said first continuous wall includes an upper portion which is substantially vertical such that it forms an upper cylindrical section of said cooling chamber.

14. A cooler as in claim 10, and further comprising:

(a) an exhaust plenum attached to said exhaust outlet; and (b) a blower positioned in said exhaust plenum.

15. A double wall vertical cooler, comprising:

(a) a first continuous wall and a ceiling which together form a cooling chamber, said first continuous wall including:

(i) a lower portion which is angled downward and inward to form a frustoconical section of said cooling chamber, a bottom portion of which forms a product outlet; and (ii) an upper portion which is substantially vertical which forms a cylindrical section of said cooling chamber;

(b) a second continuous wall at least partially surrounding said frustoconical section said cooling chamber, said second continuous wall being connected to said first continuous wall to form a cooling air circulating chamber immediately outside of said frustoconical section of said cooling chamber;

(c) a cooling air inlet into said air circulating chamber;

(d) a product inlet in an upper section of said cooling chamber;

(e) an exhaust outlet formed in said upper section of said cooling chamber;

(f) an exhaust plenum attached to said exhaust outlet;

(g) a blower positioned in said exhaust plenum;

(h) a plurality of apertures formed in said lower portion of said first continuous wall which apertures connect said air circulating chamber to said cooling chamber, said apertures being spaced from each other such that said plurality of apertures are arrayed over an area encompassing a substantial portion of said lower portion of said first continuous wall; and (i) a controlled exit device positioned in said product outlet.

16. A cooler as in claim 15, wherein said controlled exit device is a slide gate.

* * * * *